US006199322B1

(12) United States Patent
Itami et al.

(10) Patent No.: US 6,199,322 B1
(45) Date of Patent: Mar. 13, 2001

(54) METHOD AND APPARATUS FOR AUTOMATICALLY DRIVING AN OPEN/CLOSE BODY

(75) Inventors: Eiji Itami; Ryoichi Fukumoto; Katsuhisa Yamada; Masao Ohhashi; Shintaro Suzuki, all of Aichi-ken (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/449,623

(22) Filed: Nov. 30, 1999

(30) Foreign Application Priority Data

Nov. 30, 1998 (JP) ..... 10-340535

(51) Int. Cl.[7] ..... E05F 15/00

(52) U.S. Cl. ..... 49/139; 49/360; 49/506; 192/120; 192/12 B

(58) Field of Search ..... 49/139, 140, 360, 49/506; 192/12 D, 18 B; 74/625

(56) References Cited

U.S. PATENT DOCUMENTS 3,599,764 * 8/1971 Daab ..... 192/12 D
4,040,508 * 8/1977 Sunada et al. ..... 192/12 D
4,870,875 * 10/1989 Morishita ..... 1921/12 D X
5,105,131 * 4/1992 Schap ..... 49/139 X
5,434,487 * 7/1995 Long et al. ..... 49/139 X

OTHER PUBLICATIONS

A brochure published by Toyota Co. Ltd. regarding the Granvia vehicle, Aug. 1995, pp. 53–62.

* cited by examiner

*Primary Examiner*—Jerry Redman
(74) *Attorney, Agent, or Firm*—Burns, Doane, Swecker & Mathis, LLP

(57) ABSTRACT

At the time of changing over an open/close body from a manual operation to an automatic operation, a reliable clutch connection is established in a power transmission system between a drive source and the open/close body thus enhancing the operability of the open/close body. An open/close body automatic drive equipment comprises a clutch mechanism which connects or interrupts a power transmission system between a motor for driving a slide door which constitutes the open/close body and the slide door, wherein a clutch of a clutch mechanism is interrupted in a manual manipulation, and in an automatic drive, a clutch is connected to operate the slide door. In such an equipment, a brake mechanism for restricting the movement of the slide door is disposed in the midst of the power transmission system, the moving speed of the slide door is detected, and in case the moving speed is higher than a given speed, the movement of the slide door is restricted by the brake mechanism BK, and then the clutch connection of the clutch mechanism is performed.

7 Claims, 14 Drawing Sheets

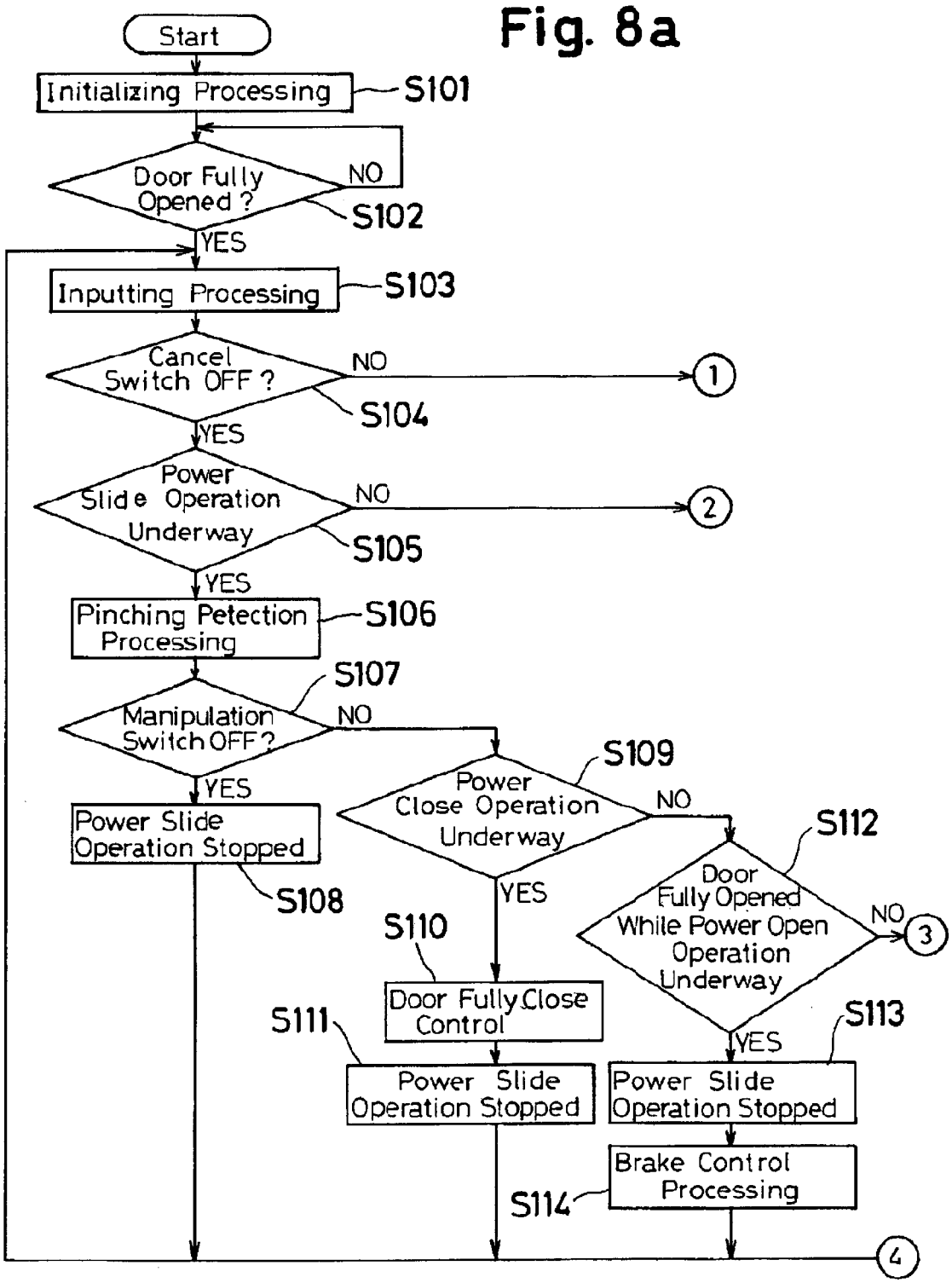
Fig. 8a
Start
Initializing Processing
S101
Door Fully Opened ?
NO
S102
YES
Inputting Processing
S103
Cancel Switch OFF ?
NO
1
S104
YES
Power Slide Operation Underway
NO
2
S105
YES
Pinching Petection Processing
S106
S107
Manipulation Switch OFF ?
NO
YES
Power Slide Operation Stopped
S108
S109
Power Close Operation Underway
NO
YES
S112
Door Fully Opened While Power Open Operation Underway
NO
3
YES
S110
Door Fully Close Control
S111
Power Slide Operation Stopped
S113
Power Slide Operation Stopped
Brake Control Processing
S114
4 radial direction circumferential direction

METHOD AND APPARATUS FOR AUTOMATICALLY DRIVING AN OPEN/CLOSE BODY

FIELD OF THE INVENTION AND RELATED ART STATEMENT

This invention relates to an open/close body automatic drive method and equipment which performs an automatic opening and closing of an open/close body (e.g., a door or sunroof of a vehicle) relative to a fixed body by electrically operating the open/close body, and more particularly, to the clutch connection timing of the clutch mechanism for electrically connecting or interrupting the power transmission system between a drive source for driving the open/close body and the open/close body by way of a clutch.

In the field of vehicles, this type of equipment is provided for improving the boarding and alighting of a crew and is represented, for example, by an equipment which electrically drives a slide door (open/closure body) mounted on the rear portion of a vehicle so as to perform an open/close operation of the slide door.

For example, with respect to a vehicle of the one-box type or the like, the slide door is mounted on the rear portion of the vehicle and a power slide door equipment which enables a manual open/close operation of the slide door or an electrical automatic driving of the slide door is adopted.

The provision for changing between a manual manipulation and an electrical automatic driving of the slide door is constituted by a clutch mechanism interposed in a power transmission system extending between the slide door and a motor for driving the slide door. In performing the manual manipulation of the slide door, a clutch of the clutch mechanism is turned off so as to interrupt the drive train extending from the slide door to the motor, while in performing the automatic open/close operation of the slide door by the automatic driving, the clutch of the clutch mechanism is turned on so that the power transmission drive train between the motor and the slide door is connected and hence, the slide door is operated by the power of the motor. The slide door control equipment which is provided with the clutch mechanism capable of changing between the manual and the automatic manipulation is disclosed on pages 53–62 of the manual 4 of new type Granvia (published in August, 1995 by Toyota Motor Corporation.)

Furthermore, in case an object to be moved (a slide door, here) is large and heavy, a toothed form of electromagnetic clutch is usually used as the clutch for connecting the power transmission system. This toothed form electromagnetic clutch is provided with a clutch face (constituting an engaging face when the clutch is connected) which is formed in a toothed shape and can have a firm engaging due to the teeth formed on the engaging face at the time of clutch connection.

If the slide door is forcefully moved manually in a closing direction from the fully opened condition, so that the moving speed of the slide door is excessively high after removing a hand from the slide door, then when the mode of operation is automatically changed over to an automatic drive, the rotational speed of the clutch mechanism becomes high. Accordingly, because of the high speed, at the time of changing over the mode of operation from the manual mode to the automatic mode, it becomes impossible to smoothly connect the toothed type of electromagnetic clutch.

In case the clutch cannot be smoothly connected at the time of switching the mode of operation, it gives rise to a stiffness or awkwardness in the operability of the slide door so that smooth shifting from the manual manipulation to the automatic driving cannot be obtained.

The present invention is made in view of the abovementioned problems and it is a technical task of the present invention to assure a reliable clutch connection between a drive source which drives the open/close body and the power transmission system of the open/close body at the time of changing over from the manual manipulation to the automatic driving and to perform the operation of the open/close body with an improved operability.

The technical means provided for solving the abovementioned tasks involves an open/close body automatic drive device which includes a clutch mechanism which connects or interrupts the power transmission system between a drive source for driving the open/close body and the open/close body wherein a clutch of the clutch mechanism is interrupted in a manual manipulation, but in an automatic drive mode the clutch is connected so as to operate the open/close body thus performing an automatic opening and closing of the open/close body relative to a fixed member. A brake mechanism for restricting the movement of the open/close body is disposed in the midst of the power transmission system. The moving speed of the open/close body is detected. In case the moving speed is higher than a given speed, the movement of the open/close body is restricted by the brake mechanism, and then the clutch connection of the clutch mechanism is performed.

Due to such a constitution, even in case the moving speed of the open/close body is higher than the given speed, the movement speed of the open/close body is reduced by means of the brake mechanism so that the clutch can be engaged. Hence, even in case a toothed form of electromagnetic clutch is used as the clutch mechanism, the speed of the open/close body is assuredly decreased so that it becomes possible to make the clutch have the reliable meshed condition.

Furthermore, here, even in case the open/close body is forcefully closed by the manual manipulation, the moving speed of the open/close body can be decreased by the application of the brake and the clutch is engaged so as to enable the shifting of the mode of operation to the automatic drive in the midst of the operation and hence, the movement of the moving body becomes smooth and the operability is enhanced.

BRIEF DESCRIPTION OF THE DRAWING

The accompanying drawings which are incorporated in and constitute a part of this specification, illustrate several embodiments of the invention and, together with the description, serve to explain the principles of this invention.

DETAILED DESCRIPTION OF THE PREFERRED EMBODIMENT

One embodiment of the present invention is explained in conjunction with attached drawings hereinafter.

Figure 1:
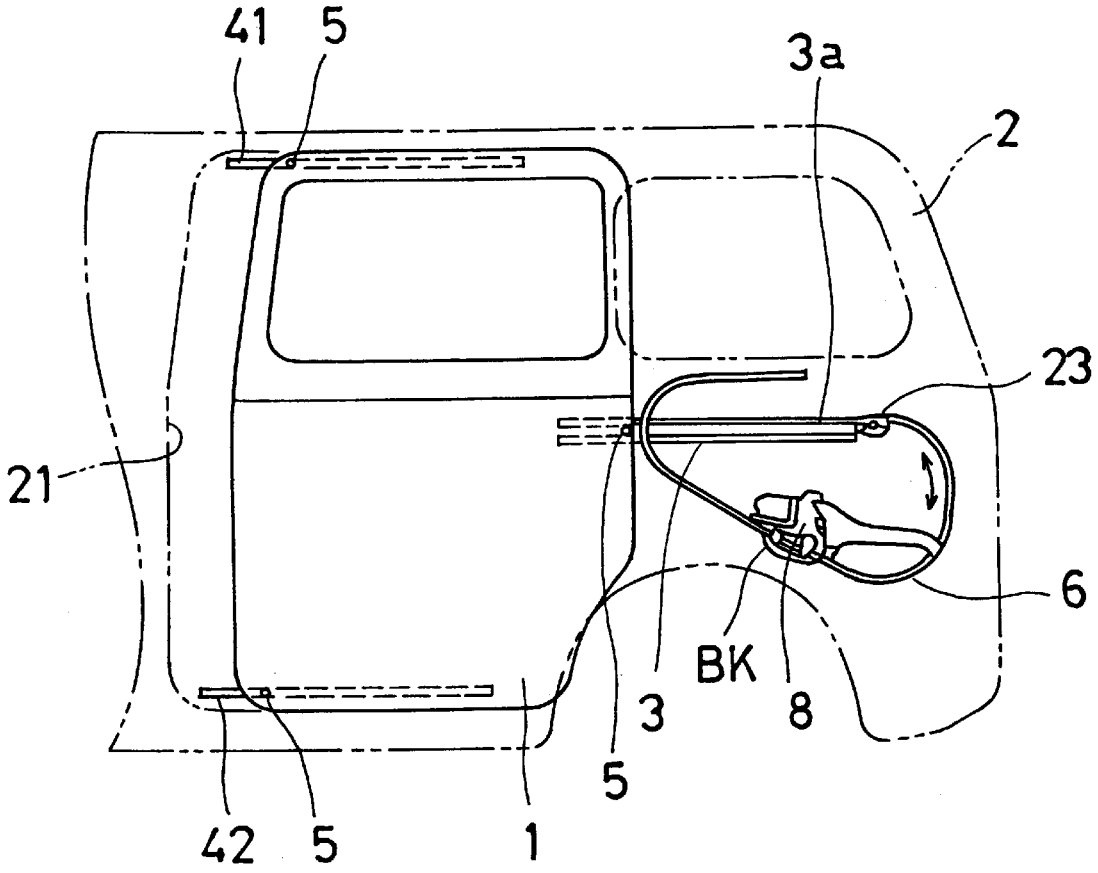
FIG. 1 is a mounting view showing an open/close body automatic drive equipment (a slide door control equipment for vehicle) of one embodiment of this invention mounted on a vehicle.

As shown in FIG. 1, a slide door 1 is provided for opening or closing a rectangular door opening 21 formed in a side body 2 of a vehicle. The slide door 1 is slidably supported in a vehicle traveling direction (in a left-and-right direction in FIG. 1) by means of a center guide rail 3 and a pair of upper and lower guide rails 41, 42 extending in the vehicle traveling direction.

The upper guide rail 41 is disposed along and in the vicinity of the upper brim of the door opening 21 and is fixedly secured to the side body 2. Furthermore, the lower guide rail 42 is disposed along and in the vicinity of the lower brim of the door opening 21 and is fixedly secured to the side body 2. The center guide rail 3 is fixedly secured to the central outer surface of the side body 2 extending from the door opening 21 to the rear portion of the vehicle.

Three sets of guide roller units 5 which are respectively slidably guided by the guide rails 3, 41, 42 are mounted on the slide door 1. The slide door 1 opens or closes the opening 21 by the sliding movement thereof, wherein rollers 5*a* of the guide roller units 5 are slidably mounted in the inside of the guide rails 3, 41, 42 which are mounted on the vehicle side so that the rollers 5*a* are guided by the guide rails 3, 41, 42. In this case, the guide rails 3, 41, 42 are disposed in parallel with each other and extend in a traveling direction of the vehicle. The front ends of the guide rails 3, 41, 42 are bent toward the inside of the vehicle for guiding the slide door 1 so as to make the outer surface of the slide door 1 coplanar with the outside surface of the side body 2 at the time of closing the door opening 21. When the door opening 21 is closed by operating the slide door 1, the outer surface of the slide door 1 and the surface of the side body 2 of the rear portion of the vehicle are aligned (flush) with each other.

Figure 6:
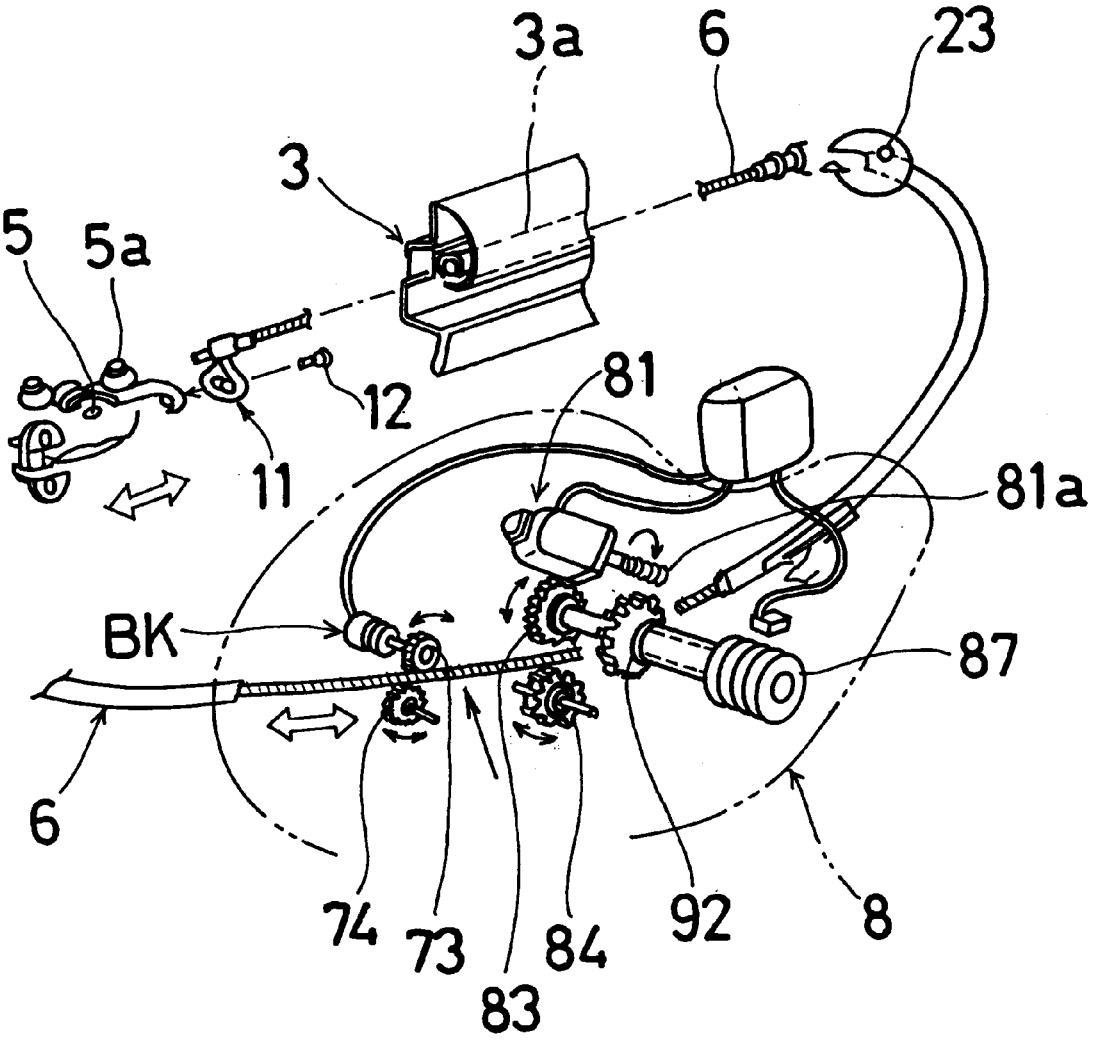
FIG. 6 is a perspective view showing a power transmission system from a motor of the drive mechanism shown in FIG. 2 to a slide door.

Subsequently, a mechanism to provide the slide movement of the slide door 1 will be explained in conjunction with FIG. 1 and FIG. 6.

The slide door 1 is connected to a geared (i.e., gear-driven) cable 6 by way of a shoe 11 which is fixedly fastened to a roller unit 5 which is mounted on the rear portion of the slide door 1. This geared cable 6 is introduced into the inside of the vehicle by way of a grommet 23 which is mounted on the rear portion of the center guide rail 3 and is pushed or pulled by means of a drive mechanism (actuator) 8 fixedly secured to the indoor side of the side body 2 of the vehicle so as to slide the geared cable 6 in the inside of a guide pipe 3*a* formed in the center guide rail 3 (see FIG. 6). As a result, three sets of roller units 5 respectively roll on in the inside of the guide rails 3, 41, 42, and the slide door 1 is opened or closed along the guide rails 3, 41, 42.

Figure 2:
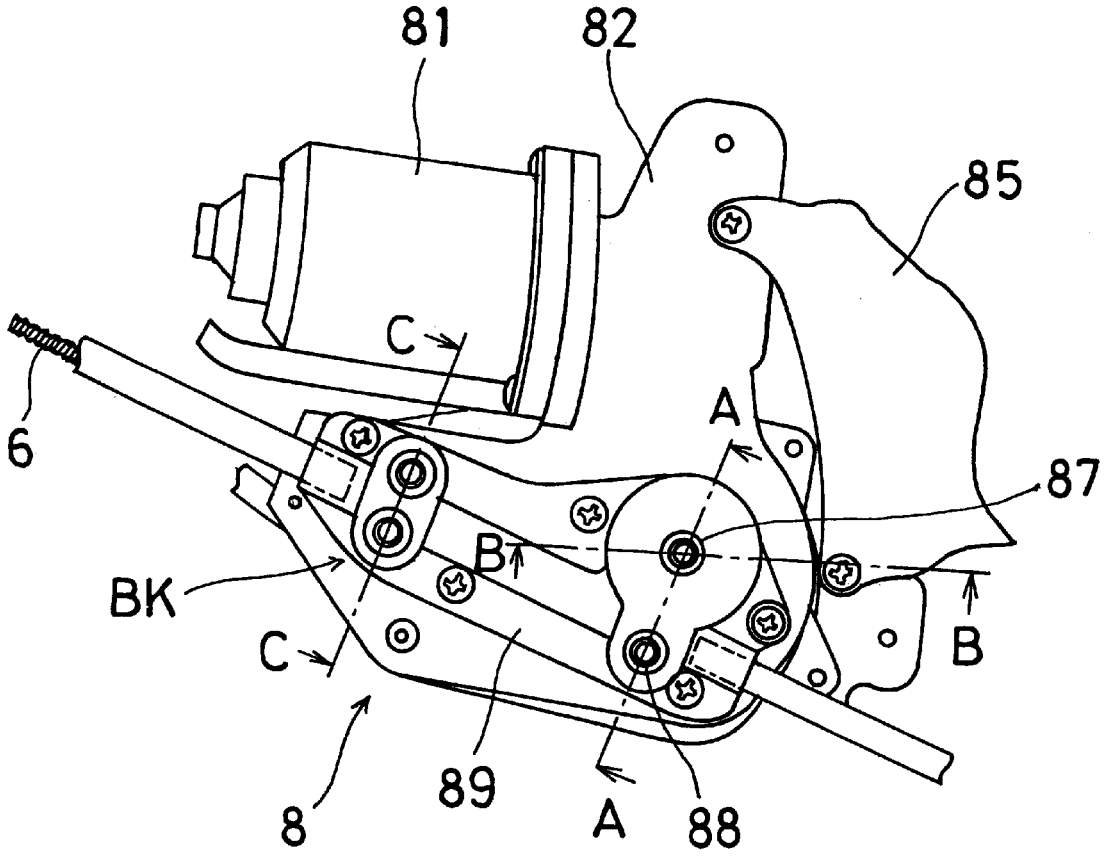
FIG. 2 is a view showing a drive mechanism of one embodiment of this invention.
Figure 3:
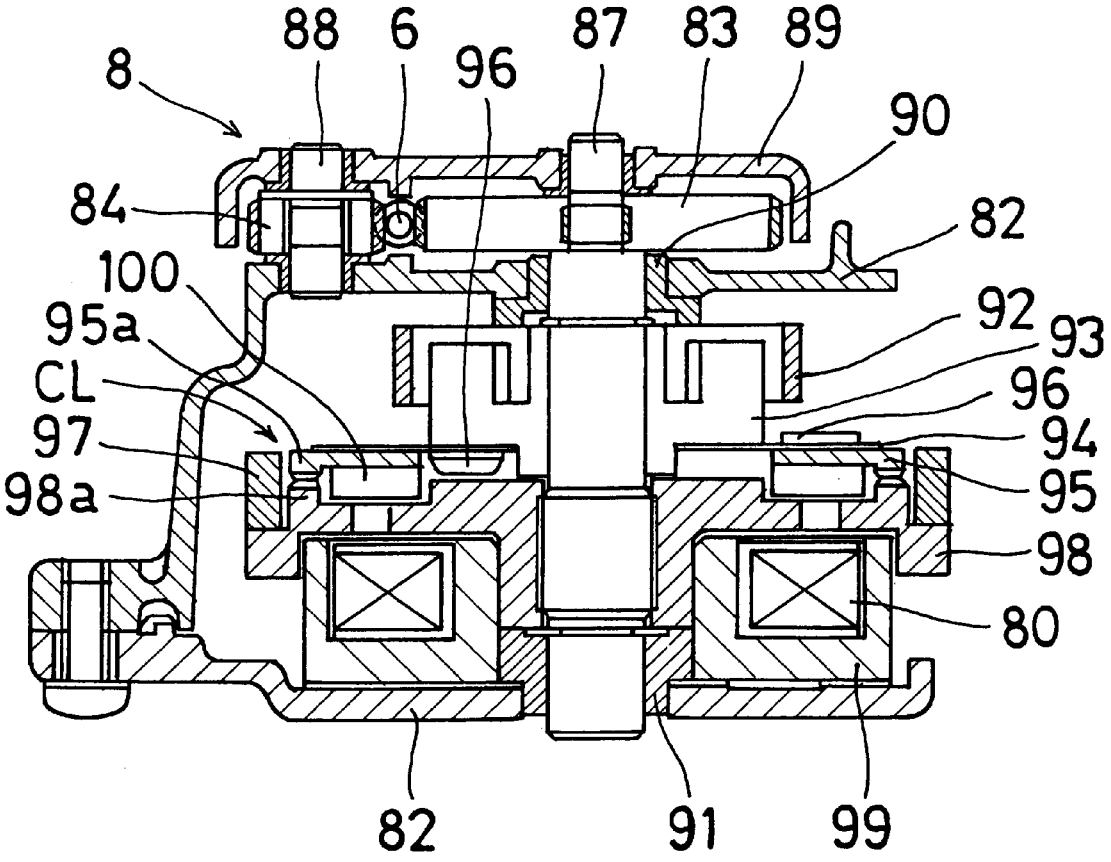
FIG. 3 is a cross sectional view of FIG. 2 taken along a line A—A.
Figure 4:
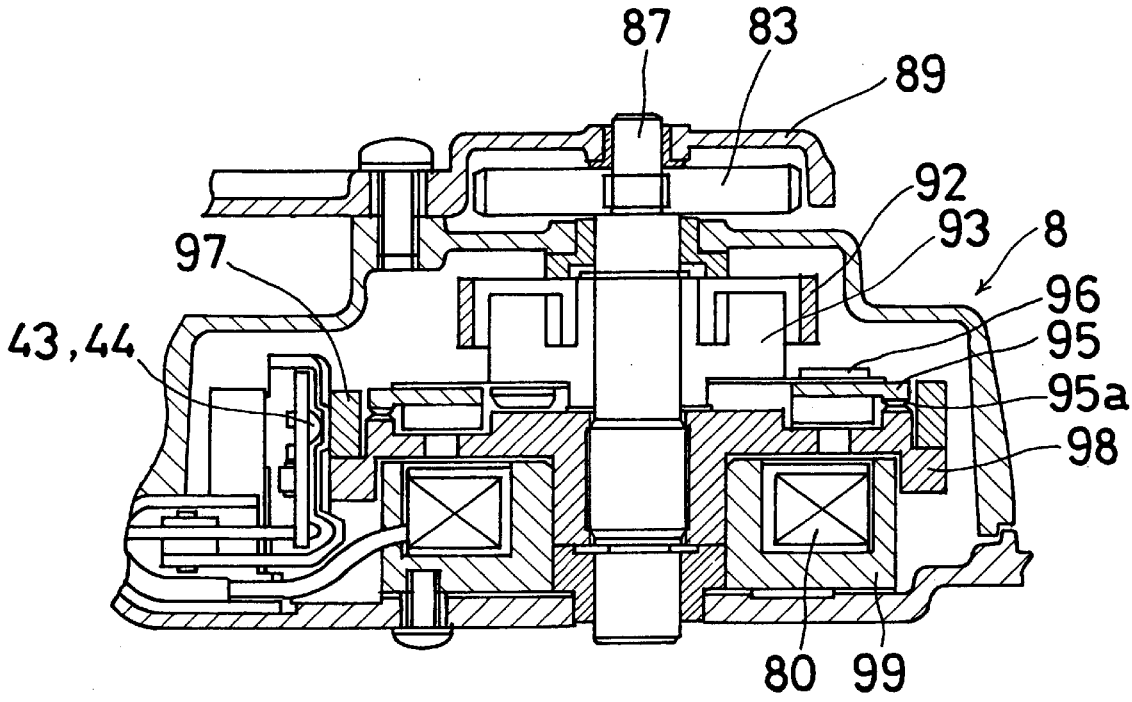
FIG. 4 is a cross sectional view of FIG. 2 taken along a line B—B.
Figure 5:
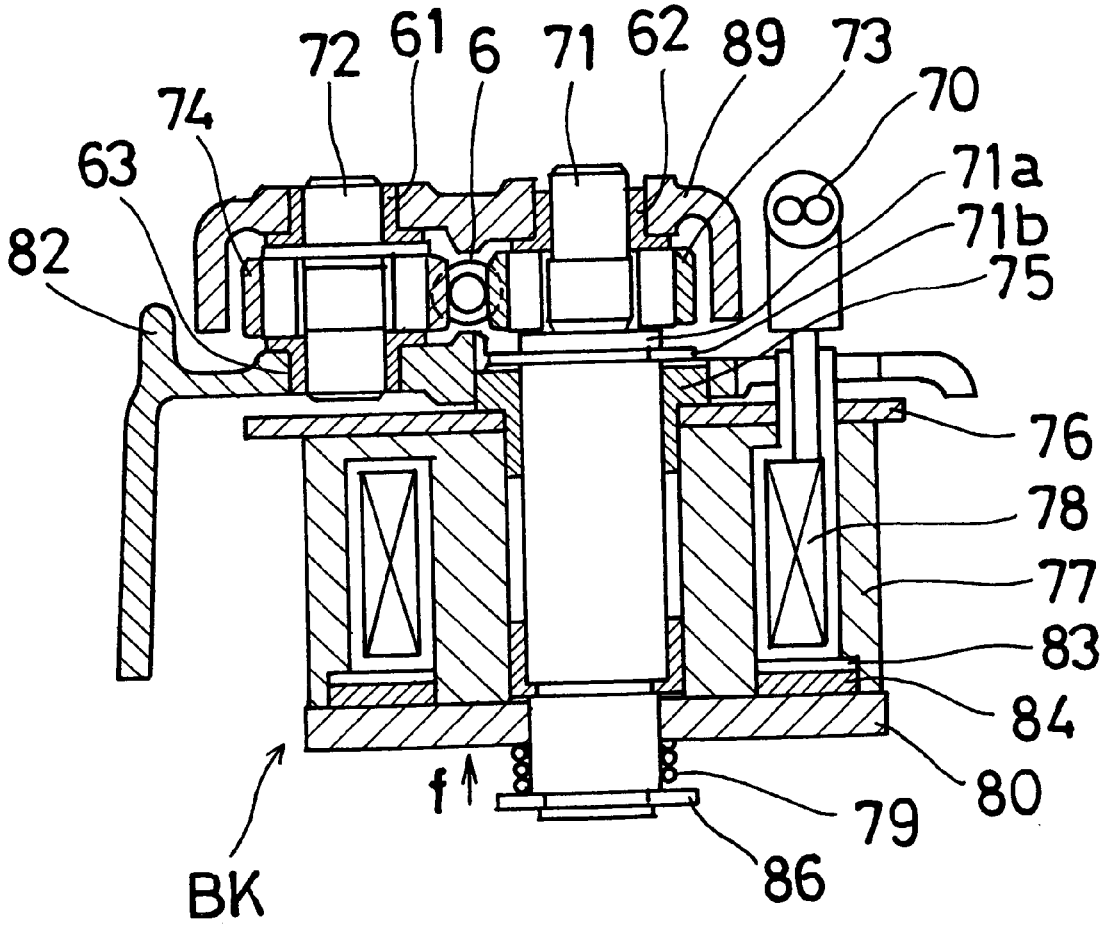
FIG. 5 is a cross sectional view of FIG. 2 taken along a line C—C.

FIG. 2 shows the construction of the drive mechanism 8 for opening or closing the slide door 1 and FIG. 3, FIG. 4 and FIG. 5 are respectively cross sectional views of FIG. 2 taken along lines A—A, B—B, C—C. The drive mechanism 8 is mounted on the inside of an indoor panel of the side body 2 of the vehicle by means of fixing means such as screws by way of a mounting bracket 85. A reduction mechanism is disposed in the inside of the housing 82 of the drive mechanism 8 and a direct current motor 81 for driving the reduction mechanism is mounted on and fixedly secured to the housing 82.

When the direct current motor 81 is electrically energized by way of an external wiring harness, electricity is supplied to a coil in the motor so that the motor 81 is rotatably driven. The rotation of the motor 81 is transmitted to a worm wheel (not shown in drawings) which is meshed with a worm 81 a (see FIG. 6) mounted on an output shaft of the motor 81. The worm wheel is mounted in the inside of the housing 82 for reducing the speed of the rotation of the motor 81, and the rotational output of the worm wheel can be transmitted to an output shaft 87 pivotally mounted on a cover 89 mounted on the housing 82. Whether such transmission of the motor output to the shaft 87 occurs, depends upon the state of a clutch mechanism, as will be hereafter described.

A serration is formed on this output shaft 87, and an output gear 83 which is provided with a serration in an inner central portion thereof is keyed to the serration of the shaft 87. Upon rotation of the output shaft 87, the output gear 83 is integrally rotated with the output shaft 87. Upon rotation of this output gear 83, the geared cable 6 is pushed or pulled (being pulled when the output shaft 87 is rotated in a clockwise direction as shown in FIG. 6 in an opening operation, and being pushed when the output shaft 87 is rotated in a counterclockwise direction as shown in FIG. 6 in a closing operation) so as to carry out the opening and closing operation of the slide door 1. In this case, the geared cable 6 which pushes or pulls the slide door 1 is meshed with a driven gear 84 mounted on a driven shaft 88 which in turn is mounted on the housing 89 on which the output gear 83 is also pivotally mounted. Due to such an arrangement, the geared cable 6 is sandwiched between the output gear 83 and the driven gear 84 and the geared cable 6 is reliably meshed with both gears 83, 84.

A clutch mechanism CL is mounted on the output shaft 87 in an axial direction. The output shaft 87 is rotatably supported by bearings 90, 91 pushed into the housing 82 and a cover 89. The output shaft 87 is provided with a serration at two portions (upper and lower portions) thereof. A rotor 98 and the output gear 83 each have outer teeth and are mounted on respective ones of these serrated portions of the output shaft 87 so as to rotate together with the shaft.

The bearing 91 is pushed into a central portion of an annular core 99 which is accommodated in the case 82. The core 99 is provided with a central opening at a central portion thereof into which the bearing 91 is pushed and also provided with a circumferential recessed portion at an outer peripheral portion thereof. In this circumferential recessed portion, a circular coil 80 which receives electricity from the outside by way of a wire harness and is coaxial with the output shaft 87 is disposed in a circumferentially wound manner in the circumferential recessed portion. Furthermore, a rotor 98 is coaxial with the core 99 in such a manner that the rotor 98 closes the opening of the circumferential recessed portion of the core 99. A ring-like magnet 97 is fixedly secured to the rotor 98 such that its outer periphery has the same diameter as that of the rotor 98. The magnet 97 is fixedly secured to the rotor 98 such that eighty sets of N/S poles are respectively alternately magnetized on the outer periphery thereof. The rotor 98 and the magnet 97 are integrally rotated upon rotation of the output shaft 87. Two rotating position detection sensors 43, 44 (FIG. 4) are provided having hole elements which change signals in response to the N/S polarities of the magnet 97 and are disposed opposite to the magnet 97 and are arranged in a circumferential direction. These sensors output waveforms whose phases are shifted 90° from each other. These sensors function as sensors for detecting the rotating condition of the motor 81, that is, the degree of opening of the slide door 1 by the rotation of the motor in this embodiment. Accordingly, these sensors 43, 44 are called door sensors. The signals obtained by these sensors are outputted to the outside by way of the harness (see FIG. 4).

Furthermore, this rotor 98 is made of magnetic material and a circumferential protrusion 98*a* is formed on the rotor 98 at the inner diameter side of the magnet 97. The protrusion 98*a* formed on the rotor 98 and a protrusion 95*a* formed on a ring member 95 extend axially and are arranged on the same diameter position in an axial direction and usually they face each other in an axially opposed manner with a given axial gap therebetween.

On the other hand, an annular armature 100 (FIG. 3) made of magnetic material for strengthening the generated electromagnetic force is fixedly secured to the ring member 95 at the inner diameter side of the protrusion 95*a* of the ring member 95. By supplying electricity to the coil 80 disposed in the core, a magnetic closed loop is formed among the core 80, the rotor 98 and the armature 100. Accordingly, due to this electromagnetic force, the protrusion 98*a* of the rotor 98 and the protrusion 95*a* of the ring member 95 are attracted to each other in an axial direction, and the rotor 98 and the ring member 95 can be integrally rotated, whereby the core 99, the coil 80, the rotor 98, the armature 100 and the ring member 95 function as an electromagnetic clutch.

Furthermore, a flat spring 94 is fixed on a surface of the ring member 95 situated opposite to the surface on which the protrusion 95*a* of the ring member 95 is formed. A hub 93 is arranged freely rotatably on the shaft 87 and is fixedly connected to the spring 94 by means of rivets 96. Thus, the hub 93 is rotated together with the ring member 95.

A gear 92 (arranged to be driven by the worm wheel that is driven by the motor 81) is fitted into the hub 93 with a suitable vibration damper (not shown) disposed therebetween. Upon rotation of the motor 81, the impact caused by the rotation of the worm wheel is absorbed by the damper and is received by the gear 92.

Due to such an arrangement, to open or close the slide door 1 using electric power, the coil 80 is first energized. When the electricity is supplied to the coil 80, the magnetic closed loop is formed among the core 80, the rotor 98 and the armature 100, whereupon the protrusion 98*a* of the rotor 98 and the protrusion 95*a* of the ring member 95 are attracted to each other in an axial direction by the electromotive force. Thus, the electromagnetic clutch CL is switched to an ON condition so that the rotor 98 and the ring member 95 are integrally rotated. In this manner, by electrically setting the clutch to the ON condition the motor 81 is driven, and the protrusion 98*a* of the rotor 98 and the protrusion 95*a* of the ring member 95 are attracted to each other due to the electromagnetic force thus forming an integral body. Under such a condition, the rotation of the motor 81 is transmitted to the worm wheel (not shown) of the reduction mechanism by means of the worm 81*a* mounted on the motor output shaft. The rotation of the worm wheel is received by the outer teeth of the gear 92 while the impact is absorbed by the damper interposed between the hub 93 and the gear 92. With the clutch held in such an ON condition, the rotation is transmitted to the rotor 98 by way of the ring member 95 which is rotated integrally with the gear 92. The force transmitted to the rotor 98 rotates the output shaft 87. As a result, the output gear 83 which is integrally rotatable with the output shaft 87 is rotated. Upon rotation of this output gear 83, along with the driven gear 84 disposed at the opposite side of the geared cable 6, the geared cable 6, which is assuredly meshed with the output gear 83 and the driven gear 84, opens or closes the slide door 1.

On the other hand, in case the slide door 1 is to be opened or closed by a manual operation, electricity is not supplied to the coil 80 and the motor 81 and hence, the clutch CL is turned off (the condition that a given gap is held between the protrusion 98*a* of the rotor 98 and the protrusion 95*a* of the ring member 95 so that the mechanical connection of the power transmission system is not established). Although the output gear 83 and the rotor 98 are rotated by the manual manipulation of the slide door 1, the power transmission train connected to the motor 81 is cut off by the deactivated clutch so that the slide door 1 can be manually opened or closed.

Subsequently, a brake mechanism BK which is attached to this drive mechanism 8 will be explained hereinafter. As shown in FIG. 2, this brake mechanism BK is mounted adjacent a path in which the geared cable 6 travels. This brake mechanism BK is operable to restrict the movement of the geared cable 6 by applying a brake to the moving geared cable 6 in case the slide door 1 is not electrically operated.

As shown in FIG. 5, a brake gear 73 which is mounted on a brake shaft 71, and a driven gear 74 which is mounted on a driven shaft 72 of the brake mechanism BK are meshed with the geared cable 6 from opposite sides thereof. The gears 73, 74 are mounted on the brake shaft 71 and the driven shaft 72 respectively by means of a serration connection so that they are integrally rotated with the brake shaft 71 and the driven shaft 72. Furthermore, the gears 73, 74 are pivotally supported by bearings 61, 62, respectively, mounted on the cover 89, and by bearings 63, 75, respectively, mounted on the housing 82 such that they are rotatable. The brake shaft 71 is provided with a flanged portion 71*a* in the midst thereof and this flanged portion comes into contact with an axial end face of the bearing 75 by way of a washer 71*b* so as to restrict the movement of the brake shaft 71 in one direction. The bearing 75 which pivotally supports the brake shaft 71 is pushed into a bracket 76 which, in turn, is fixedly secured to the housing 82. A cylindrical core 77 which is made of a magnetic body is fixedly secured to one side face of the bracket 76 by welding or the like. The bracket 76 is provided with a recessed portion in the inside thereof, and a coil 78 is accommodated in the recessed portion. On the inside of the recessed portion where the coil 78 of the core 77 is accommodated, a shoulder portion is formed and, on this shoulder portion, an annular metal plate 83 made of stainless steel (SUS) and a friction plate 84 which superposes the metal plate 83 are disposed so as to close an opening where the coil 78 is disposed. In the condition that the metal plate 83 and the friction plate 84 are disposed on the shoulder portion, the friction plate 84 slightly protrudes from one end face of the core 77. Furthermore, to close the opening end of the recessed portion of the core 77 where the friction plate 84 is provided, a disc-like armature 80 made of a magnetic body is mounted on the brake shaft 71 coaxially with the core 77. This armature 80 and the brake shaft 71 are engaged with each other by means of a serration connection so that when the brake shaft 71 is rotated due to the meshing of gears 73, 74 with a moving geared cable 6, the armature 80 and the brake shaft 71 are integrally rotated. In this case, since the driven gear 74 is disposed at the opposite side of the brake gear 73 with respect to the geared cable 6, the geared cable 6 is assuredly meshed with the brake gear 73 and the driven gear 74.

Furthermore, on the outer periphery of the brake shaft 71, a coil spring 79 is mounted for biasing the armature 80 toward the friction plate 84. For holding the spring 79 in a compressed state, a ring member 86 is fitted into a groove formed in the brake shaft 71 in the vicinity of the end portion of the brake shaft 71. In such a construction, since axial movement (removal) of the brake shaft 71 in one direction is stopped by the flange portion, the armature 80 is pushed against the core by the biasing force of the spring 79 such that the armature 80 comes into contact with the friction plate 84.

In such an arrangement, the coil 78 is energized from the outside by way of a wire harness 70 and hence, electricity is supplied to the coil 78. The coil 78 is wound in a circumferential direction relative to the brake shaft 71 so as to establish a closed loop magnetic circuit among the coil 78, the core 77 and the armature 80. Due to the electromagnetic force, the armature 80 is attracted to the friction plate 84. This restricts the relative rotation which is generated between the non-rotational core 77 and the armature 80 which is integrally rotated with the brake shaft 71 when the geared cable 6 is moved. That is, the brake is applied to the brake shaft 71 by an operation of an electromagnetic clutch (brake clutch) constituted by the coil 78, the core 77 and the armature 80 so that the speed of the brake shaft 71 can be restricted.

In this case, by restricting the rotation of the brake shaft 71 which is integrally rotated with the armature 80 based on the amperage which flows in the coil 78 and the energizing time, the rotation of the brake gear 73 is restricted. As a result, the movement of the geared cable 6 which is meshed with the brake gear 73 is restricted so that the brake force is applied to the geared cable 6.

Figure 7:
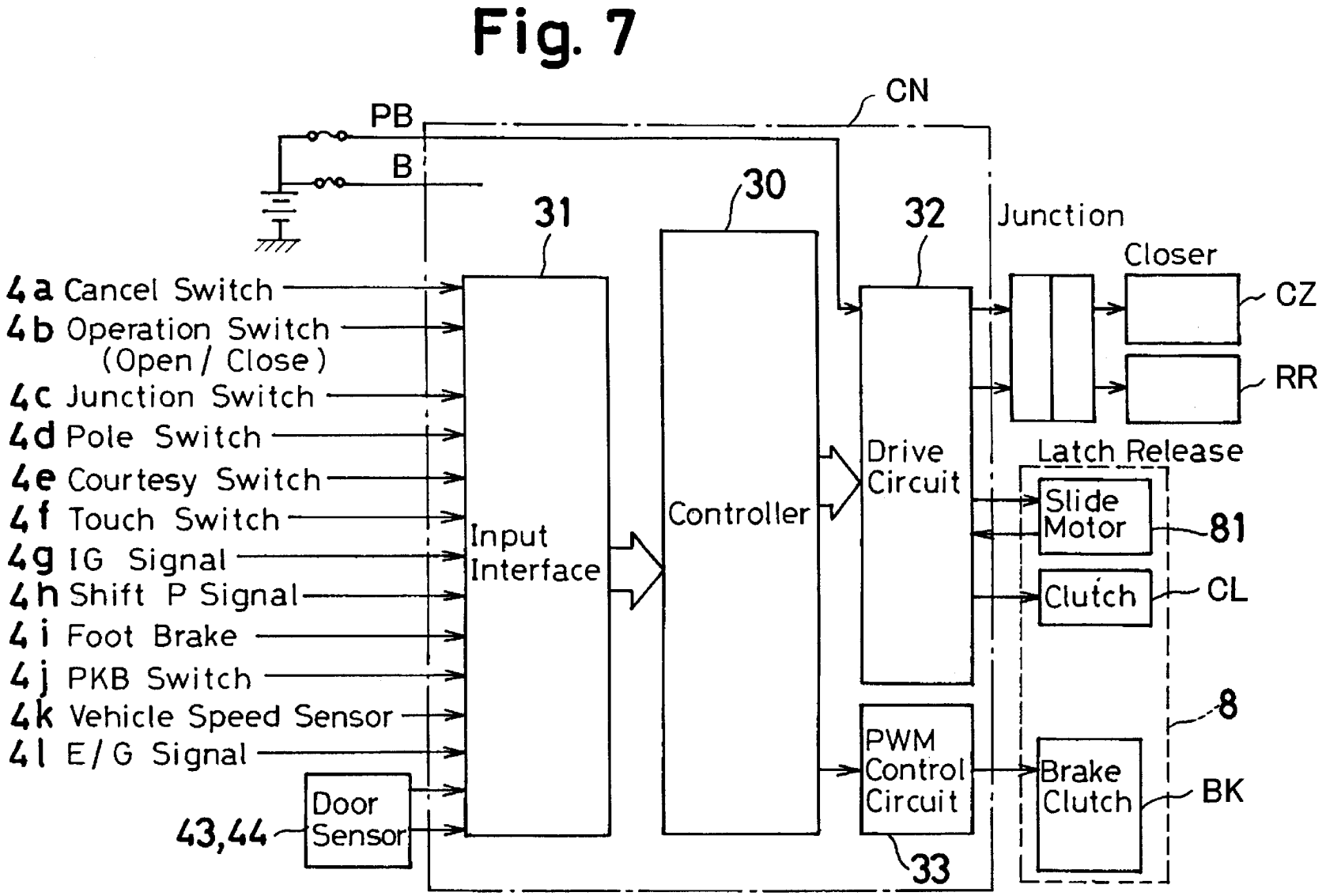
FIG. 7 is a block diagram showing the external connections of a control equipment of one embodiment of the present invention.

Although the clutch mechanism CL and the brake mechanism BK of the drive mechanism 8 for opening or closing the slide door 1 have been explained heretofore, the manner of operation of the slide door 1 is explained in view of FIG. 1 and FIG. 7 hereinafter.

A cancel switch 4*a* is provided in the vicinity of the driver's seat. When in an "off" state, the cancel switch permits automatic operation of the door, and when in an "on" state the cancel switch prevents such automatic operation.

Also, a manipulation switch 4*b* is disposed in the vicinity of the driver's seat to control the automatic opening and closing of the door. That is, by manipulating, e.g., pushing, the manipulation switch, the slide door 1 can be fully opened or fully closed automatically by the electric motor 81. On the other hand, when the slide door 1 is slightly opened manually from the fully closed condition, or slightly closed manually from the fully opened condition, the slide door 1 is automatically fully opened or fully closed thereafter. To be more specific, in the opening operation, provided that the cancel switch 4*a* is turned off, when the manipulation switch is pushed 'OPEN' (the manipulation switch may be a two stage OFF/OFF switch), the latch of the slide door 1 is automatically released (in case the slide were latched), and so long as the pushing of the manipulation switch is continued, the slide door 1 is automatically operated until it reaches the fully opened position. On the other hand, provided that the cancel switch 4*a* is turned off, if the manipulation switch is pushed to a door-closed position, the slide door 1 is automatically operated in a closing direction and on the point of being fully closed, a closer CZ is operated so as to fully close the slide door 1.

Furthermore, provided that the cancel switch 4*a* is turned off, when the slide door 1 is manually moved from the fully closed position toward the fully opened position, the slide door 1 is automatically closed the rest of the way once the user releases the door handle. That is also true if the door is manually moved from a closed position toward an open position, i.e., the door is automatically moved the rest of the way to the fully open position when the handle is released.

In this embodiment, in case the supply of electricity to the drive transmission system of the slide door 1 is cut off by turning the cancel switch 4*a* "on", to set the slide door 1 in a free condition (i.e., a condition wherein the clutch of the drive mechanism for electrically operating the slide door 1 is turned off so that the slide door 1 can be moved freely by a manual manipulation) and the vehicle is in an inclined condition such as being placed on a descending slope or the like, the slide door 1 is liable to start its movement due to its own weight and may pinch a passenger. In this embodiment, to prevent such an accident, the brake mechanism BK prevents the slide door 1 from exceeding a given speed as will be explained.

The internal constitution and the external connection of the control unit CN will now be explained in connection with FIG. 7. Upon receiving signals from various switches and sensors by way of an input interface 31, a controller 30 executes the open/close control of the slide door 1 in response to these signals. The drive mechanism which drives the slide door 1 is driven by a drive circuit 32 in response to the output signal from the controller 30 so as to push or pull the geared cable 6 thus opening or closing the slide door 1. The brake clutch BK which restricts the movement of the geared cable 6 is controlled by a PWM control circuit 33.

Then, to explain switches and sensors which detect the conditions of the vehicle, the cancel switch 4*a* is a switch which cancels the power slide control when it is turned on, the manipulation switch 4*b* is a switch which automatically opens the slide door 1 when pushed to a door OPEN state and automatically closes the slide door 1 when in a door CLOSE position. A pole switch 4*d* is a switch which is incorporated in the inside of an actuator of the door closer CZ and detects whether the slide door 1 is at a half latch condition (incompletely latched condition) or at a full latch condition (fully latched condition). A courtesy switch 4*e* is a switch which is turned on in response to the slide door 1 being in the opened condition, and which is turned off in response to the slide door 1 being in the closed condition. A touch switch 4*f* is a switch which is disposed at a position where the slide door 1 is closed and detects whether the touch switch is pushed or the disconnection occurs. A PKB (parking brake) switch 4*j* is a switch which detects whether a parking brake is pulled or not. A junction switch 4*c* is a switch which detects whether the junctions are connected or not and supplies electricity to an actuator for carrying out a latch release (releasing the latch) RR by way of the junction switch 4*c* when the slide door 1 is in the fully closed condition. Besides the above-mentioned switches and sensors, for detecting the conditions of the vehicle, an IG (ignition) signal 4*g*, a shift P signal 4*h*, a foot brake signal 4*i*, an E/G signal 41, a signal from a vehicle speed sensor 4*k* which detects the vehicle speed, and signals from door sensors 43, 44 which detect the open/close condition of the slide door 1 are inputted to the input interface.

On the other hand, the door closer CZ performs the operation of the slide door 1 from the half latch condition to the fully closed condition at the time of closing the slide door 1, and the latch release RR performs the release of the latch at the time of opening the slide door 1.

The signals and the vehicle condition signals (the IG signal, the shift P signal, the foot brake signal, E/G signal) from the above-mentioned various switches (cancel switch, the door open switch, the door close switch, the pole switch, the courtesy switch, the touch switch, the IG switch, the PKB switch) and sensors (the vehicle speed sensor, the door sensors) are inputted to the control unit CN, and in response to these signals, the controller 30 judges the vehicle conditions, and operates the slide motor 81 of the slide door 1 and the clutch CL by way of the drive circuit 32. The controller 30 also outputs the signal to the PWM control circuit 33 so as to make the PWM control circuit 33 output the PWM signal thus operating the brake clutch BK.

Subsequently, the processing at the controller 30 of the control unit CN for operating the slide door 1 will be explained in conjunction with FIG. B. When electricity is supplied to the control unit CN from a battery, the control unit CN executes the main routine shown in FIG. 8. Here, only essential steps of the processing of the present invention are explained hereinafter.

Figure 8B:
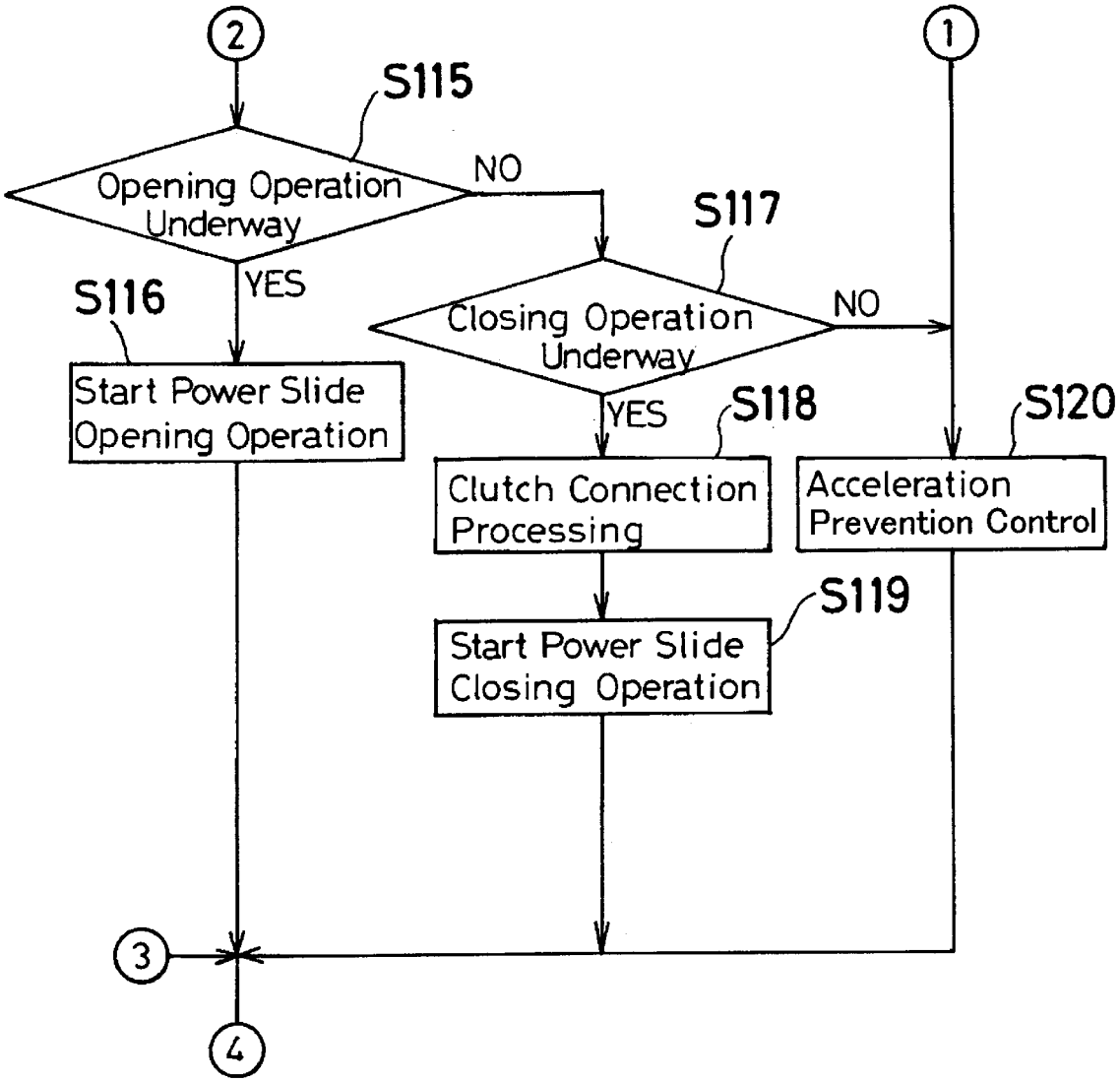
FIG. 8 is a main flow chart showing the processing carried out by a controller shown in FIG. 7.

In FIG. 8, an initializing is executed at step S101. Here, conditions of ROM and RAM are checked and whether this system is normally operated or not is checked after setting initial values to memories necessary for this processing. At step S102, whether the slide door 1 is in the fully closed condition or not is checked. The door fully closed condition is determined in view of the conditions of the pole switch 4*d* and the courtesy switch 4*e*. It is determined that the slide door 1 is in the fully closed condition when the pole switch 4*d* is in the latched condition (half latched condition or fully latched condition) and the courtesy switch 4*e* is in the OFF condition (door closed condition). At step S102, in case the slide door 1 is fully closed, an inputting processing is executed at step S103. In the inputting processing, when the signals from various switches and various sensors (see FIG. 7) which indicate the current various vehicle conditions are inputted to the input interface 31 of the control unit CN, these signals are inputted to the controller 30 and stored in necessary memories in the controller 30.

Then, at step S104, whether the cancel switch 4*a* which cancels the electric operation (power slide operation) of the slide door 1 is pushed or not is checked. Here, in case the cancel switch 4*a* is pushed (ON condition), an acceleration prevention control which controls the movement of the slide door 1 is executed at step S120 and the processing returns to step S103. However, in case the cancel switch 4*a* is not pushed (OFF condition), whether the power slide operation is under way or not is checked at step S105. The determination whether the power slide operation is under way or not is executed by watching the condition of the power slide opening and closing operation flag. In case the power slide operation is not under way, the processing is advanced to step S115. In case the power slide operation is under way, the processing is advanced to step S106 where a pinching detection processing is executed. In this pinching detection processing, the pinching of the passenger or the like to the body side (pillar) which may occur due to the movement of the slide door 1 is detected.

After executing the pinching detection processing, whether the open or close manipulation switch 4*b* is pushed or not is checked at step S107. Here, in case the manipulation switch 4*b* is not pushed, at step S108, the power slide opening and closing operations flag is cleared while holding the clutch CL in the ON condition, and the motor 81 is turned off so as to stop the power slide operation and the processing returns to step S103.

In case the power slide operation is not under way at step S105, the processing returns to step S115. Here, whether the manipulation switch 4*b* is pushed to the door-open side or not is checked, and at the moment when it is detected that the manipulation switch 4*b* is switched to the door-open side, the flag relating to the power slide open operation is set so as to start the power slide open operation and the processing returns to the step S103.

On the other hand, in case the condition of step S115 is not established (other than the moment that the manipulation switch 4*b* is pushed to the door-open side), whether the manipulation switch 4*b* is pushed to the door-close position or not is checked. Here, the moment that it is detected that the manipulation switch 4*b* is pushed to the door-closed side the clutch connecting processing is executed at step S118. In case the slide door 1 is electrically driven and the manipulation switch 4*b* is manipulated, when the slide door 1 is moved to a position of a given distance by the manual manipulation, this clutch connecting processing energizes the coil 80 of the drive mechanism 8 so as to make the coil 80 generate the electromagnetic force which connects the clutch CL to make the rotor 98 and the ring member 95 rotate integrally, thus carrying out the power slide operation by the electric power. In this case, whether the door speed for moving the slide door 1 exceeds a given speed or not is checked and in case the door speed exceeds the given speed, a brake is applied by means of the brake mechanism BK so as to slow down the moving speed of the slide door 1. After completing the clutch connecting processing, the power slide close opening flag is set at step S119 and the processing returns to step S103.

In case the manipulating switch 4*b* is pushed to the door open side or the door close side at step S107, the processing at step S109 and ensuing steps are executed. At step S109, whether the junction switch 4*c* is changed over from the OFF condition to the ON condition during the power closing operation, that is, whether a female terminal mounted on a portion to which the slide door 1 of the body side is connected and a male terminal which comes into contact with the female terminal mounted at the slide door side are connected with each other or not during the slide door closing operation (to be more specific, before the closer CZ is operated, the slide door 1 is in the condition that it is substantially closed at a position some tens mm in front of the fully closed position) is checked. In case the junction switch 4*c* is changed over from the off condition to the ON condition, at step S110, the operation is moved from the slide operation to the closer operation and the door closing control for closing the slide door 1 from the incompletely closed condition to the completely closed condition is executed. In step S111, the motor 81 is turned off, the clutch CL is turned off and the power slide close operation flag is cleared and after stopping the power slide operation, the processing returns to the step S103.

Figure 13A:
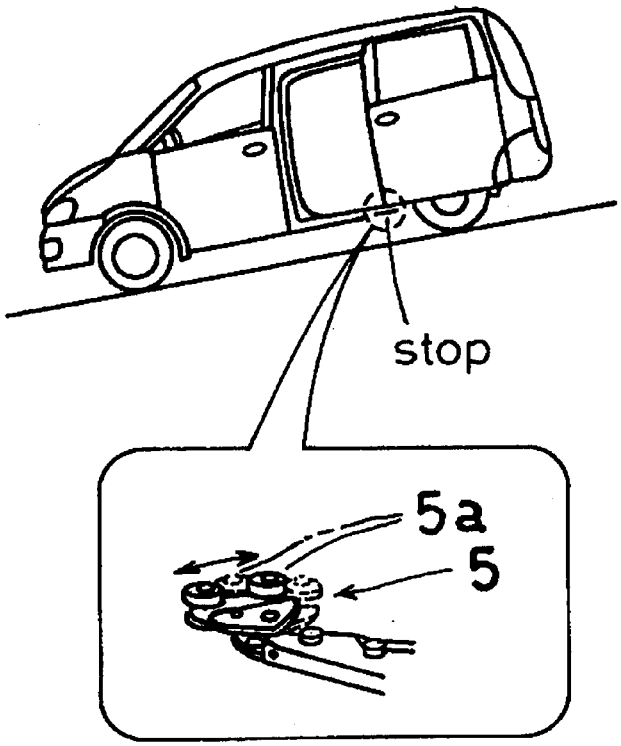
FIGS. 13(*a*) and 13(*b*) are explanatory views, wherein FIG. 13(*a*) shows the constitution of a roller unit which moves the slide door along a guide rail in case a vehicle is in an inclined condition and FIG. 13(*b*) shows the relationship between rollers of the roller unit and a check spring which stops the rollers in a given place.
Figure 13B:
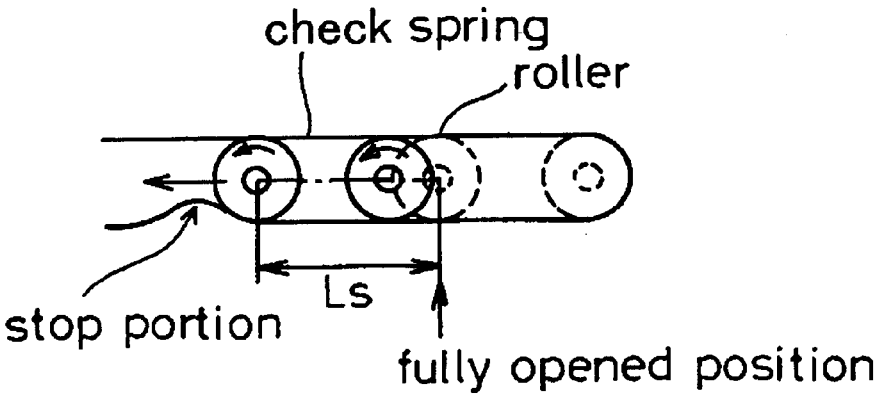

On the other hand, at step S109, in case the junction switch 4*c* is not changed over from the OFF condition to the ON condition (not in a completely closed condition), at step S112, whether the slide door 1 is fully opened during the power opening operation this time or not is checked. Here, in case the condition of the step S112 is not established (in case the door is not fully opened during the power slide opening operation), the processing returns to the step S103. In case the slide door 1 is fully opened by the power slide movement, at step S113, the motor 81 is turned off, the clutch CL is turned off and the power slide open operation flag is turned off so as to stop the power slide operation. Thereafter, since the slide door 1 is in the fully opened position here, at step S114, a brake control for intermittently applying the brake to enable the door to return to a position where it is held open (the holding position where the rollers 5*a* of the roller units 5 for supporting the slide door 1 are stopped by the action of the check spring mounted on the vehicle-side lower guide rails) is executed in case the vehicle is in an inclined condition as well as the door being in an open condition. Hence, the roller 5*a* is assuredly stopped by the stopping portion so that the door is in a free condition. Accordingly, as shown in FIG. 13(*a*), even when the vehicle is in an inclined condition and the clutch CL is turned off to make the slide door 1 in a free condition, the position of the roller 5*a* can be shifted to a stopper portion so as to prevent the slide door 1 in the open condition from overriding the stopper portion of the check spring so that the roller 5*a* is assuredly stopped at the stopper portion of the check spring and the slide door 1 can be held open even on a slope or the like.

Figure 9:
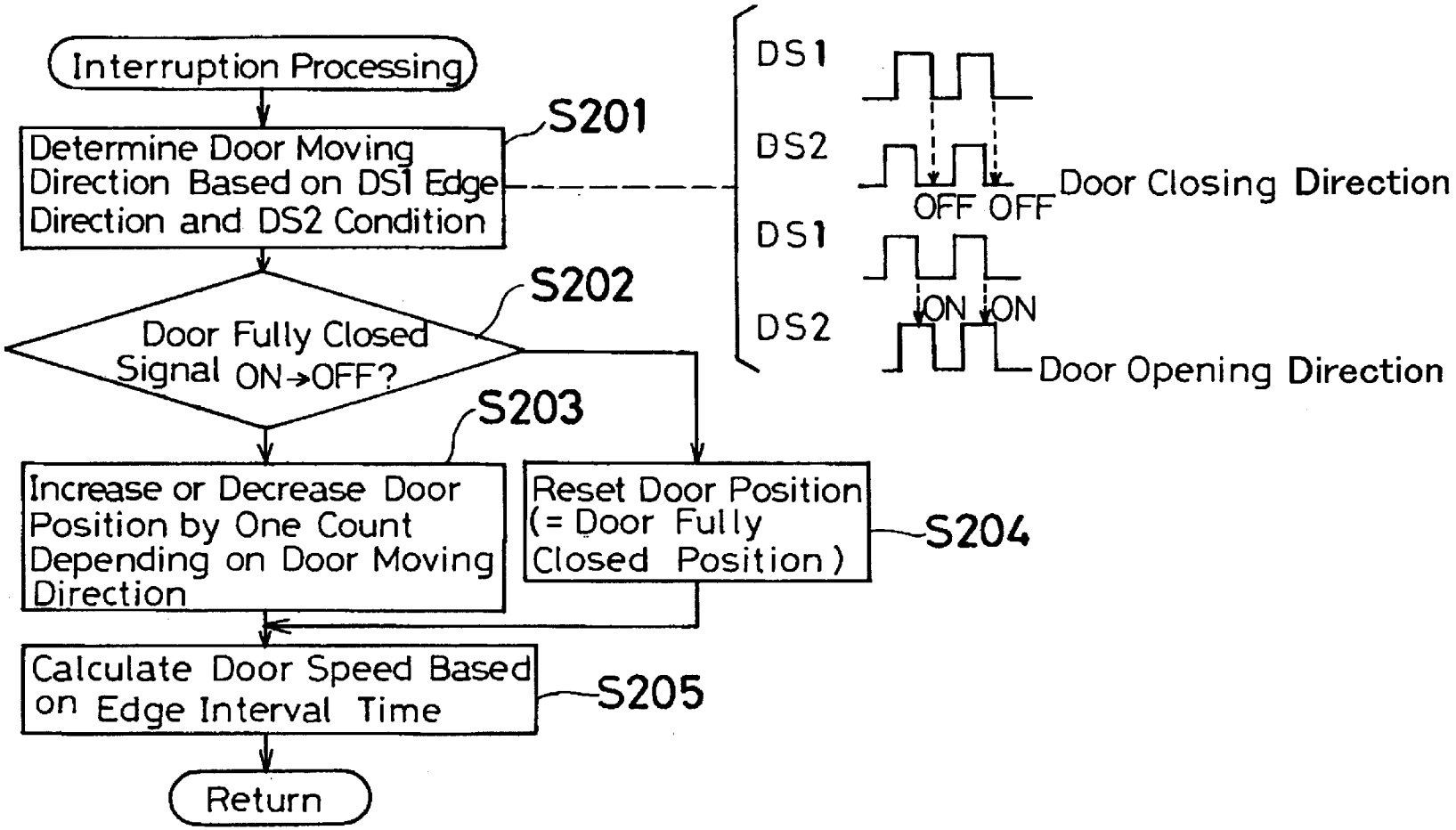
FIG. 9 is a flow chart showing the interruption processing carried out by a controller shown in FIG. 7.

Subsequently, the interruption processing shown in FIG. 9 is explained hereinafter. Signals from door sensors 43, 44 are inputted to the control unit CN. In case the leading edge and the trailing edge of this signal are inputted, the interruption processing is automatically executed against the main routine. In this processing, at step S201, based on the edge direction of the door sensor 43 (DS1) and the electric potential level of another sensor 44 (DS2), the moving direction of the door is determined (see the interpretation of the flow). Thereafter, whether the slide door 1 is moved in an opening direction from the fully closed condition or not (whether the signal is changed from the ON condition to the OFF condition) is checked. In case the slide door 1 is opened from the fully closed condition, the door position is reset as the door fully closed position and a time between an edge of DS1 and an edge of one preceding DS1 is obtained and the inverse number thereof is calculated to obtain the door speed.

In this processing, at the very moment the slide door 1 is opened, the value of a door position counter which stores where the slide door 1 is currently positioned is reset and initializing is executed at the fully closed condition. However, in case the slide door 1 is not opened from the fully closed condition, the reset is not executed and at step S203, the door position counter is incremented in an opening direction and decremented in a closing direction depending on the door moving direction, and the door condition is stored sequentially, and thereafter, at step S205, since the distance between the edges is constant, the door speed can be calculated by taking the inverse number of the edge interval time.

To be more specific, when the edge of DS1 is detected, the condition of DS2 at the point of time is read. In case DS2 is high (high electric potential H) at the trailing edge of DS1 or DS2 is low (low electric potential L) at the leading edge of DS1, it is detected that the slide door 1 is moved by one pulse in a door opening direction, while in case DS2 is low at the trailing edge of DS1 or DS2 is high at the leading edge of DS1, it is detected that the slide door 1 is moved by one pulse in a door closing direction, and the door fully closed position is initialized as the origin. Each time the edge enters DS1, the count number of the door position is increased or decreased so as to recognize the door position.

Due to such an arrangement, each time the edges are inputted from the door sensors 43, 44, this processing is executed, and information on the door position, the door velocity and the moving direction of the slide door 1 are obtained as door information by the interruption processing.

Figure 10:
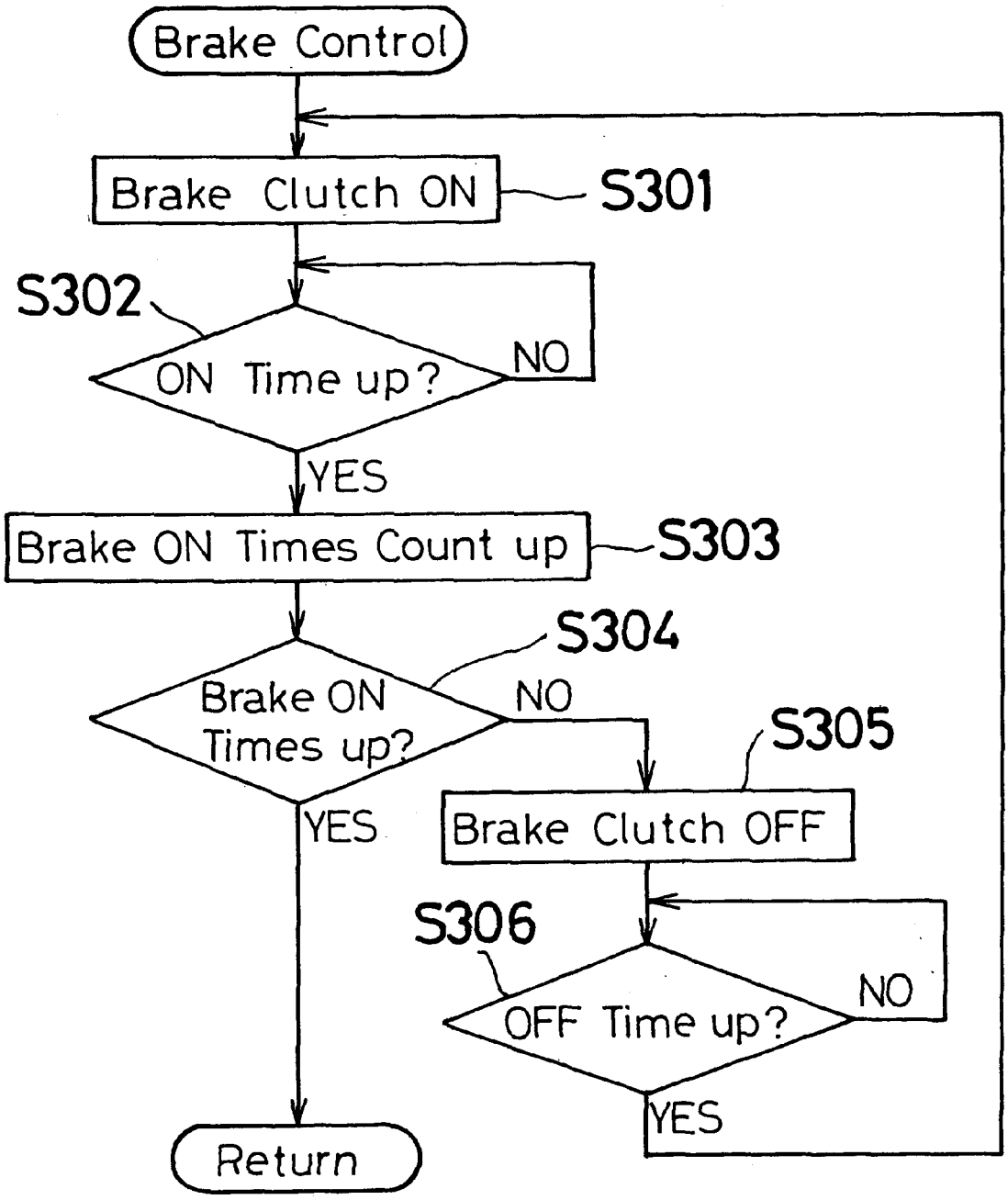
FIG. 10 is a flow chart showing a brake control processing shown in FIG. 8.

Now, the brake control at step S114 of the main routine shown in FIG. 8 will be explained in conjunction with FIG. 10. In the operation of the brake, in case the clutch of the clutch mechanism CL of the power transmission system is interrupted (the energization of the coil 80 is stopped) after the slide door is electrically opened to the fully opened position, the brake is intermittently applied to the geared cable 6 such that the position of the roller 5*a* of the roller unit 5 is moved to a stopper portion ST (see FIG. 13) of the check spring so as to restrict the movement of the geared cable 6 thus assuredly preventing the roller 5*a* from overriding the stopper portion ST.

Then, to explain this processing in detail, the brake clutch of the brake mechanism BK is turned on at step S301. This brake clutch ON condition is a condition that a closed loop is formed by the core 77, the coil 78, and the armature 80 by supplying an electric current to the coil 78 of the brake mechanism BK so that the armature 80 is attracted toward the friction plate 84 due to an electromagnetic force. As a result, the rotation of the brake shaft 71 which is integrally formed with the armature 80 is restricted by the friction force generated between the armature 80 and the friction plate 84 so that the movement of the geared cable 6 is restricted and the braking force is applied to the movement of the geared cable 6. In this case, this braking force becomes proportional to an amperage supplied to the coil 78 by way of the harness 70 since the electric current supplied to the coil 78 is controlled by the PWM circuit 33.

Then, at step S302, whether a given time (for example, 100 ms) has elapsed after turning on the brake clutch or not is checked, and after waiting the lapse of the given time (100 ms), the number of brake ON times is counted at step S303. Then, whether the number of brake ON times has exceeded the given number of times (for example, eight times) or not is checked at step S304. Here, in case the number of brake ON times has not reached the given number of times (eight times) the supply of electricity to the coil 78 is stopped to turn off the brake clutch at step S305. In step S306, when the OFF time elapses a given time (60 ms), the processing returns to stop S301 and the same processing executed at step S301 and succeeding steps are repeated. On the other hand, at step S304, in case the number of brake ON times has exceeded the given number of times (eight times), this processing is completed. In this case, the number of ON/OFF times for supplying electricity to the coil 78 and the number of repeating ON/OFF times are not limited to this and can be set within a range that the slide door does not override the stopper portion ST when the slide door 1 is set in a free condition by making the roller 5*a* approach to the stopper portion ST of the check spring as close as possible or aligned with the stopper portion ST so that even when the vehicle is parked or stopped on the slope or the like, the slide door 1 can be assuredly held at the holding position after being moved to the fully opened position.

Figure 11:
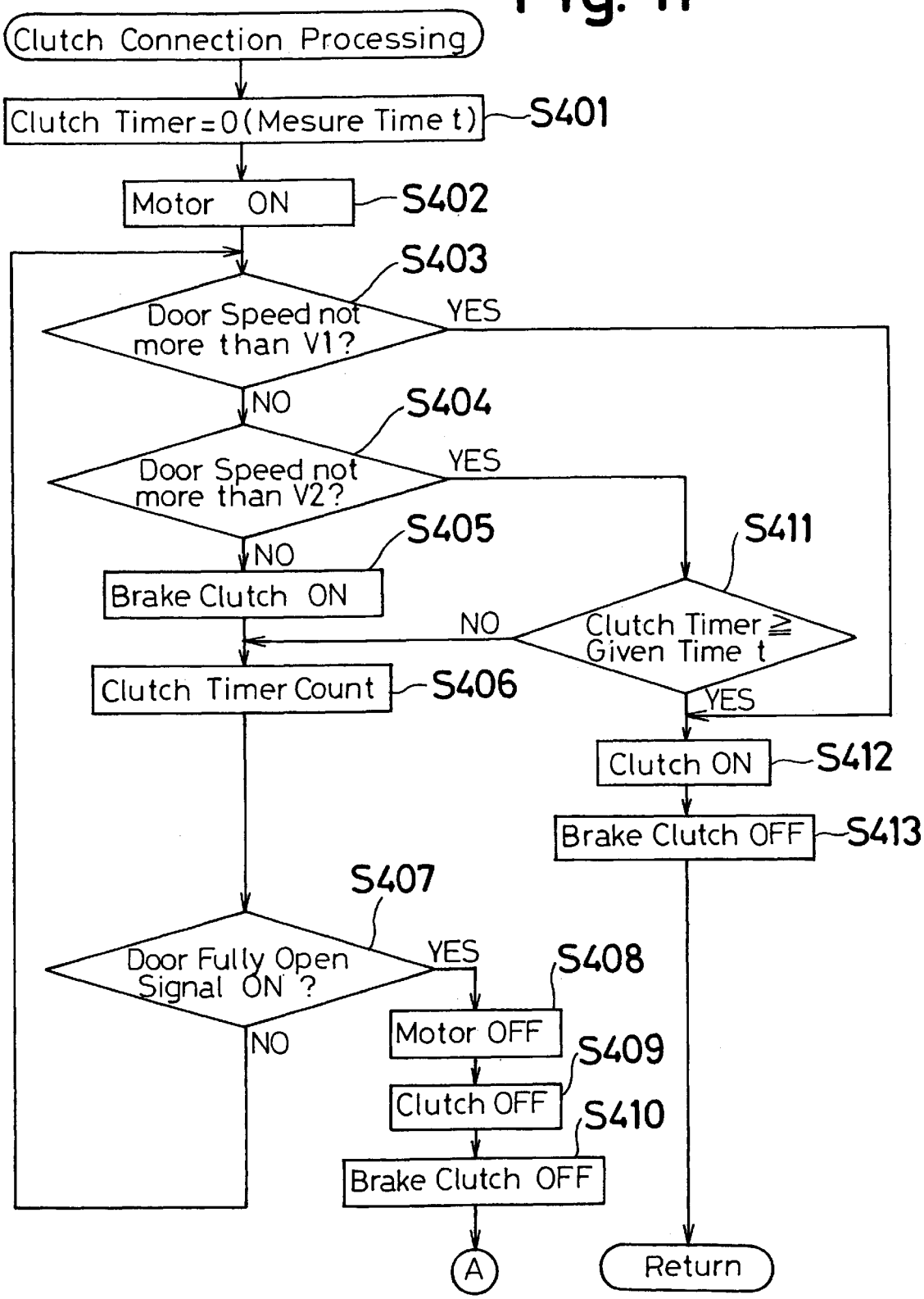
FIG. 11 is a flow chart showing a clutch connection processing shown in FIG. 8.
Figure 12A:
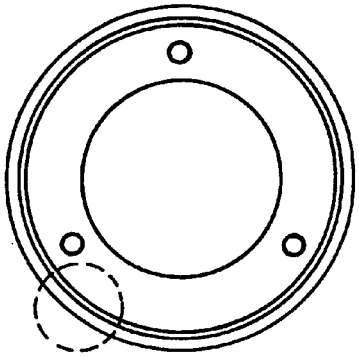
FIGS. 12(*a*), 12(*b*), 12(*c*) are views showing a ring member of a clutch mechanism according to one embodiment of the present invention, wherein FIG. 12(*a*) is an appearance view of the ring member, FIG. 12(*b*) is a cross section in a radial direction of a protrusion formed on the periphery of the ring member, FIG. 12(*c*) is an enlarged view of a circumferential essential portion of the ring member.
Figure 12B:
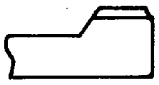
Figure 12C:
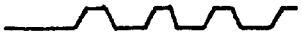

Subsequently, the clutch connecting processing which features the present invention is explained in conjunction with FIG. 11. In this processing, the toothed form of electromagnetic clutch (a protruding portion formed on a clutch engaging face in a radial direction (see FIG. 12(*b*)) and formed in a tooth form style in a circumferential direction (see FIG. 12 (*c*)) is used as the clutch element (the ring member 95 and the rotor 98) of the clutch mechanism CL of the power transmission system. When the slide door is manually forcefully moved in a closing direction from the fully opened position and the moving speed of the slide door is excessively high after removing a hand from the slide door, the clutch connection of the toothed magnetic clutch is assuredly established in the changing over of the mode of operation from the manual operation to the automatic drive.

In this processing, the clutch timer which counts the clutch connection time is cleared or reset at step S401 and the motor 81 is energized such that the motor 81 is turned on at step S402.

Then, whether the door speed obtained by the interruption processing is equal to or below a given speed VI (for example, the door speed corresponding to the motor rotating speed of 3200 rpm) is checked based on signals from the door sensors 43, 44. In case the door speed is equal to or below the given speed V1, the processing is advanced to step S412. Here, however, in case the door speed is larger than the given speed V1 (3200 rpm), then, whether the door speed is equal to or below a given speed V2 (the door speed corresponding to the motor rotational speed of 6800 rpm) which is larger than the given speed V1 or not is checked. Here, in case the door speed is equal to or below the given speed V2, the processing at step S411 is executed. In case the door speed is larger than the given speed V2 (in case the door speed is high), the meshing of the toothed form of clutch shown in FIG. 12 at the time of clutch connection is facilitated by energizing the coil 78 of the brake mechanism BK at steps S405, S406 so that electromagnetic force is generated and the brake clutch is turned on so that the brake is applied against the movement of the slide door. At step S406, the timer which counts the time from starting of the operation of the motor 81 counts up. Thereafter, in step S407, whether the condition of the slide door 1 is in the fully closed condition or not is checked based on the condition of the pole switch 4*d* and the courtesy switch 4*e*. In case the condition of the slide door 1 has not yet become the fully closed condition, the processing returns to step S403 and the processing of step S403 and succeeding steps are repeated. In case the condition of the slide door 1 has become the fully closed condition at step S407, since the closing operation of the slide door 1 is completed from step S08 to step S10, the supply of electricity to the motor 81 is stopped to turn off the motor 81 and the clutch CL is turned off (the power transmission system between the motor 81 and the slide door 1 being interrupted) and the brake clutch is turned off (the condition where the brake generated by the operation of the brake mechanism BK being not applied to the movement of the slide door 1), and the processing returns to the main routine (A: step S103).

On the other hand, in case the door speed of the slide door 1 is within the range of the given speed V1–V2 (3200–6800 rpm), whether the time after the brake clutch of the brake mechanism BK is connected has elapsed a given time t (200 ms) or not is checked. Here, in case the time after the brake clutch is connected has not yet reached the given time t (200 ms), the processing is moved to step S406 and the counting by the clutch timer is executed continuously. In case the given time (200 ms) has passed after the brake clutch is connected, the clutch CL for electrically operating the slide door 1 is turned on (the condition where the electromagnetic force is generated by energizing the coil 80 and the rotor 98 and the ring member 95 are integrally rotated) and then the brake clutch is turned on at steps S412, S413 thus completing this processing.

That is, in this clutch connection processing, in case it is detected that the speed of the slide door 1 is excessively increased or has reached the speed equal to or more than a given value (the given speed V2) manually, the brake clutch which makes use of the friction force of the planner disc is turned on so that the brake is applied to the movement of the slide door 1. Then, if it is detected that the speed of the slide door 1 has become the speed equal to or below the given value (the given speed V1), the clutch of the clutch mechanism CL which performs the electrically operated drive is turned on and simultaneously the brake clutch is turned off and hence, the speed of the slide door 1 can be decreased to the safety speed. Furthermore, when the door speed of the slide door 1 is sufficiently decreased, the toothed form of clutch is turned on so as to shift the mode of operation to the automatic drive. Still furthermore, by adjusting the transmission torque of the brake clutch and slowly decreasing the door speed, the control without a stiffness can be performed.

Although the slide door control equipment is explained as an example of the open/close body automatic drive equipment, the open/close body automatic drive equipment is not limited to this and can be applied to a power window, a sun roof or the like in the vehicle.

According to the present invention, in an open/close body automatic drive device which includes a clutch mechanism which connects or interrupts the power transmission system between a drive source for driving the open/close body and the open/close body wherein a clutch of the clutch mechanism is interrupted in a manual manipulation, and in an automatic drive, the clutch is connected so as to operate the open/close body thus performing an automatic opening and closing of the open/close body relative to a fixed member, a brake mechanism for restricting the movement of the open/close body is disposed in the midst of the power transmission system, the moving speed of the open/close body is detected, and in case the moving speed is higher than a given speed, the movement of the open/close body is restricted by the brake mechanism, and then the clutch connection of the clutch mechanism is performed. Due to such a constitution, even in case the moving speed of the open/close body is higher than the given speed, the brake is applied to the movement of the open/close body by means of the brake mechanism so that the moving speed can be decreased and then the clutch connection of the clutch mechanism is established and hence, even in case the toothed form of electromagnetic clutch is used as the clutch element, the speed of the open/close body is assuredly decreased so that it becomes possible to make the clutch have the reliable meshed condition.

Furthermore, here, even in case the open/close body is forcefully closed by the manual manipulation, the moving speed of the open/close body can be decreased by the application of the brake and clutch connection is established so as to enable the shifting of the mode of operation to the automatic drive in the midst of the operation and hence, the movement of the moving body becomes smooth and the operability is enhanced.

What is claimed is:

1. An apparatus comprising:

a member forming an opening;

an open/close body movably mounted on the member for opening and closing the opening; and a mechanism for controlling movement of the open/close body comprising:

a drive source, a power transmission system for connecting the drive source with the open/close body for automatically opening and closing the open/close body, and including a clutch disengageably interrupting a drive transmission to the open/close body thereby permitting manual opening and closing of the open/close body, and a speed detector detecting a speed of the open/close body, and a braking mechanism connected to the speed detector so as to restrict a speed of the open/close body in response to a detected speed being higher than a reference speed, even when the open/close body is forcefully closed by manual manipulation, facilitating an engagement of the clutch.

2. The apparatus according to claim 1 wherein the clutch mechanism includes a toothed clutch element.

3. A method of controlling an open/close body which opens and closes an opening of a member, comprising the steps of:

A. disengaging a clutch of a power transmission system between a drive source and the open/close body;

B. manually moving the open/close body from one of an open position and a closed position toward the other of the open position and the closed position with the clutch disengaged;

C. detecting a manually-induced speed of the open/close body generated in step B;

D. activating a brake to reduce the speed of the open/close body when the speed detected in step C exceeds a reference speed even when the open/close body is forcefully closed by manually moving the open/close body; and E. engaging the clutch to connect the drive source with the open/close body to automatically finish the movement of the open/close body, following step D.

4. The method according to claim 3 wherein step E includes engaging a toothed clutch element.

5. A slide mechanism of a vehicle comprising:

a slide element movably mounted on a vehicle for movement between an open position and a closed position;

a motor;

a power transmission system connecting the motor with the slide element to automatically move the slide element between the open and closed positions;

a disengageable clutch which when engaged interrupts drive transmission from the motor to the slide element to permit the slide element to be moved between the open and closed positions through manual manipulation;

a speed detector detecting a speed of movement of the slide element; and a braking mechanism connected to the speed detector restricting movement of the slide element when the speed of movement of the slide element detected by the speed detector, during movement of the slide element in response to said manual manipulation, is greater than a reference speed.

6. The apparatus according to claim 5, wherein the clutch mechanism includes a toothed clutch element.

7. The apparatus according to claim 5, wherein the slide element is a slide door.

* * * * *